US005163455A

United States Patent [19]

Pointe et al.

[11] Patent Number: 5,163,455

[45] Date of Patent: Nov. 17, 1992

[54] MANICURE FILE FOR ACRYLIC NAILS

[76] Inventors: Robert Pointe; Barbara Pointe, both of 103 Cantebury Dr. West, West Palm Beach, Fla. 33407

[21] Appl. No.: 882,443

[22] Filed: May 12, 1992

[51] Int. Cl.[5] ..... A45D 29/18

[52] U.S. Cl. ..... 132/76.4; 132/73

[58] Field of Search ..... 132/76.4, 76.5, 73, 132/75.6

[56] References Cited

U.S. PATENT DOCUMENTS

| | | | |
|---|---|---|---|
| 847,012 | 3/1907 | Korper | 132/75.6 |
| 1,586,441 | 5/1926 | Blom | 132/76.4 |
| 1,780,072 | 10/1930 | Patrell | 132/75.6 |
| 2,233,438 | 3/1941 | Troya | 132/76.4 |
| 3,809,101 | 5/1974 | Shimizu | 132/76.4 |
| 4,765,350 | 8/1988 | Moore | 132/76.4 |
| 4,930,529 | 5/1990 | Whitney | 132/76.5 |

*Primary Examiner*—John G. Weiss

*Attorney, Agent, or Firm*—Malloy, Downey & Malloy

[57] ABSTRACT

A manicure file for acrylic nails including an elongate, substantially flexible yet rigid stick with opposite distal ends having flat upper and lower surfaces and, a rounded peripheral edge. A layer of resilient material is adhered to each of the distal ends in sandwiched relation between the stick and an outer exposed layer of emery material disposed in covering relation thereto, wherein hardened acrylic nail outer and inner surfaces and nail edges can be filed smooth without damaging the cuticle or skin surrounding the nail.

7 Claims, 1 Drawing Sheet

MANICURE FILE FOR ACRYLIC NAILS

BACKGROUND OF THE INVENTION

1. Field of the Invention

The present invention relates to a nail file and, more particularly, to a manicure file for acrylic nails which permits a user to quickly and carefully file smooth the surfaces and edges of hardened acrylic nails, while avoiding contact with and damage to the cuticles and skin surrounding the nail, as well as permitting a user to easily access and file an underside of the nail when necessary.

2. Description of the Related Art

Acrylic nails are popularly used as a fashionable alternative to one's own natural nails. Ordinarily, the process of applying acrylic nails requires first applying a plastic nail tip to a person's natural nail, wherein a portion of the underside of the nail tip is glued to the outer edge of the natural nail so as to extend outwardly. After the adhesive dries and the nail tip is set, liquid acrylic is applied to the upper exposed surface of the natural nail as well as the nail tip to form a uniform upper nail surface. After the liquid acrylic cures and hardens, it is necessary to file down any bumps on the upper exposed surface and underside of the nail as well as the edges around the cuticle and nail tip.

Presently, most manicurists use a standard emery board to file down the exposed surfaces of acrylic nails until the surfaces are smooth, at which time nail polish can be applied thereto. The standard emery boards which are presently used were originally designed for use on natural nails in which only the edges of the nail tip are filed. The problem encountered with using a standard emery board to file acrylic nails results from the large size and rather cumbersome shape of the emery board which tends to contact and rub against the cuticles and surrounding skin when filing the upper surface and edges of the hardened acrylic nail. Further, the underside of the nail can often become rough or discolored, particularly at a point where the acrylic nail contacts and is adhered to the natural nail. As a result of the generally rounded shape of standard emery boards, the tightly curved inner surface cannot be easily and safely filed.

Accordingly, the present manicure file was specifically designed to eliminate the above-mentioned problems associated with the use of commonly known emery boards in the preparation of acrylic nails.

SUMMARY OF THE INVENTION

The present invention is a manicure file for acrylic nails which includes an elongate, substantially flexible, yet rigid stick with opposite distal ends having flat upper and lower surfaces disposed at an angled orientation to one another so as to converge toward the outer distal tip, with a rounded peripheral edge extending about the distal tip between the upper and lower surfaces. A layer of resilient material is adhered to each of the distal ends in substantially covering relation thereto, and a layer of emery material is adhered to the resilient material in covering relation, such that the abrasive surface of the emery material is exposed.

The main object of the present invention is to provide a manicure file for acrylic nails structured and configured to enable a user to easily manipulate the manicure file when filing the upper exposed surfaces and edges of acrylic nails, particularly where the nail meets the skin, while avoiding contact with the cuticles and skin surrounding the nail, and preventing damage thereto.

Another object of the present invention is to provide a manicure file for acrylic nails which is structured and configured to conform generally with the upper surface of nails during filing.

Another object of the invention is to provide a manicure file for acrylic nails which is inexpensive to manufacture and thus being available for use by a wide spectrum of the consuming public. Yet another object of the invention is to provide a file which will enable the tightly curved underside of a nail to be conveniently and safely filed.

Various other objects and advantages of the present invention will be readily apparent from the following description.

DESCRIPTION OF THE DRAWINGS

For a fuller understanding of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
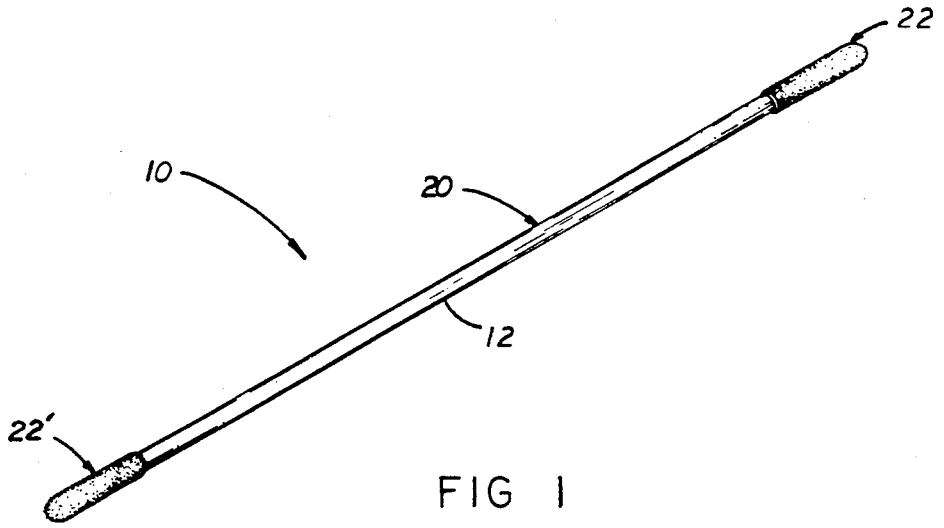
FIG. 1 is a perspective view showing a manicure file of the present invention for filing acrylic nails.

Referring to FIG. 1 in the drawings, the present invention is directed to a manicure file for acrylic nails, generally designated by the numeral 10. More specifically, the manicure file consists of an elongate, substantially flexible rigid stick 12 which includes a central portion 20 and two opposite distal ends 22, 22'. In the preferred embodiment, the rigid stick is cylindrical with a diameter of approximately ⅛ inch and a length of approximately 6 inches.

Figure 2:
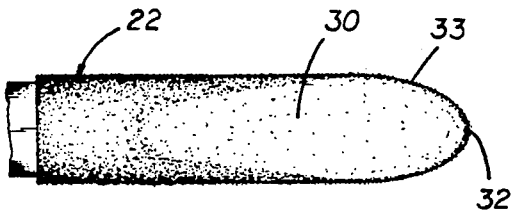
FIG. 2 is an isolated view of one of the distal ends of the manicure file of the present invention.
Figure 3:
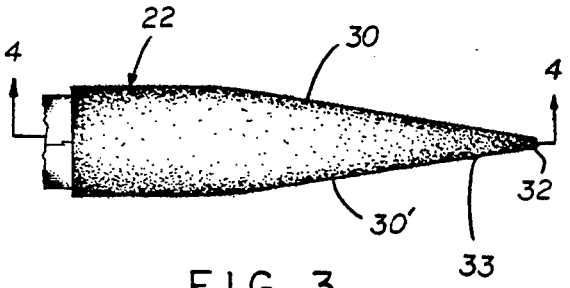
FIG. 3 is a side view thereof.
Figure 4:
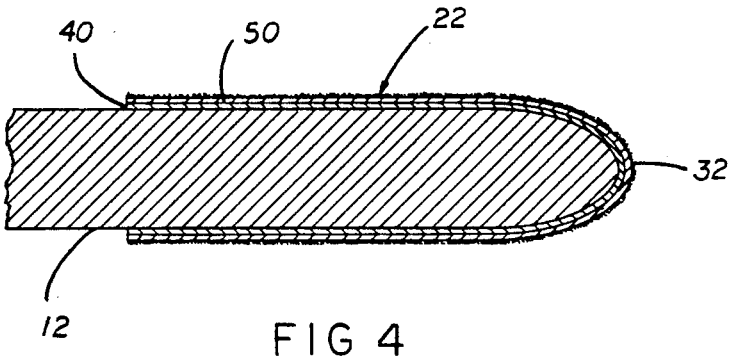
FIG. 4 is a cross-sectional view taken along line 4—4 in FIG. 3.

Referring now to FIGS. 2–4 which best show the distal ends 22 and 22', it is seen that the ends are generally of a wedge-shape design. More particularly, each distal end includes substantially flat upper and lower faces 30, 30' angled so as to converge towards the outermost distal tip 32. A rounded peripheral edge 33 extends about the distal ends between the upper and lower faces. The curvature of the rounded peripheral edge is shaped to allow the distal ends to contact the fingernail at the intersection of the nail and surrounding skin without contacting and damaging the cuticles and surrounding skin. Although, the rounded peripheral edge of the distal ends is shown to have the same curvature in FIG. 1, it will be appreciated that in order to account for various fingernail sizes and shapes, the rounded peripheral edge of the distal ends may be of different curvature.

Referring now to FIG. 4, it is seen that the distal ends of the rigid stick also includes a layer of resilient material 40 and a layer of emery material 50. The layer of resilient material 40 is adhered to each of the distal ends in sandwiched relationship between the stick and the outer exposed covering layer of emery material 50. The emery material 50 is adhered to the resilient material 40 such that an outer abrasive surface of the emery material is exposed. The layer of resilient material 40 is specifically adapted to yield in response to pressure applied thereto, so as to permit the layer of emery material to conform to the contour of the fingernail. In this manner, the area of contact of the emery material with the nail surface is increased. In addition, the emery material 50 which is adhered to each of the distal ends may be of different grit. For example, the emery material of one distal end may be coarse with large particles for initial filing of hardened acrylic nail, while the emery material of the other distal end may be of a finer grade, with smaller particles for subsequent filing and finishing of the nail surface.

In the preferred embodiment, the elongate, substantially flexible yet rigid stick 12 is made of biodegradable material. Further, although the stick is illustrated as being cylindrical, it is evident that any other cross-sectional shape such as square, rectangle or ellipse may be employed.

While this invention has been shown and described in what is considered to be a practical and preferred embodiment, it is recognized that departures may be made within the spirit and scope of this invention which is therefore not limited except as set forth in the following claims and within the doctrine of equivalents.

Now that the invention has been described,

What is claimed is:

1. A manicure file for acrylic nails comprising:

an elongate, substantially flexible, yet rigid stick including a central portion and two opposite distal ends, each of said opposite distal ends including substantially flat upper and lower faces disposed at an angled orientation to one another so as to converge towards a distal tip, each of said distal ends further including a rounded peripheral edge extending about said distal tip between said upper and lower faces, a layer of resilient material adhered to each of said distal ends in substantially covering relation thereto, and a layer of emery material adhered to said resilient material in covering relation thereto, such that an abrasive surface of said emery material is disposed in exposed relation on said distal ends of said stick.

2. The manicure file as set forth in claim 1 wherein said stick is made of biodegradable material.

3. The manicure file as set forth in claim 2 wherein said stick is approximately 6 inches in length.

4. The manicure file as set forth in claim 3 wherein said stick is cylindrical and approximately ⅛ inch in diameter.

5. The manicure file as set forth in claim 4 wherein a first one of said distal ends includes said emery material adhered thereto having a different grade of coarseness than said emery material adhered to a second one of said distal ends.

6. The manicure file as set forth in claim 5 wherein said rounded peripheral edge of said distal ends is specifically shaped and configured to facilitate filing of an upper exposed surface of an acrylic nail, including edges thereof, while preventing contact with cuticles and skin surrounding the nail.

7. The manicure file as set forth in claim 6 wherein said rounded peripheral edge of said distal ends is specifically shaped and configured to facilitate filing of a tightly rounded underside of an acrylic nail while preventing contact with skin beneath the nail.

* * * * *